US005090921A

United States Patent [19]

van der Laar

[11] Patent Number: 5,090,921

[45] Date of Patent: Feb. 25, 1992

[54] CONNECTING MEANS

[75] Inventor: Fritz J. van der Laar, Heemstede, Netherlands

[73] Assignee: Lumiance B.V., Haarlem, Netherlands

[21] Appl. No.: 671,420

[22] Filed: Mar. 20, 1991

[30] Foreign Application Priority Data

Mar. 22, 1990 [NL] Netherlands ..... 9000674

[51] Int. Cl.[5] ..... H01R 13/00

[52] U.S. Cl. ..... 439/668

[58] Field of Search ..... 439/449, 460, 579, 580, 439/668, 669

[56] References Cited

U.S. PATENT DOCUMENTS 2,480,843 9/1949 Follmer ..... 439/668
2,857,581 10/1958 Henning ..... 439/669
2,911,614 11/1959 Davis ..... 439/668

*Primary Examiner*—Joseph H. McGlynn

*Attorney, Agent, or Firm*—Cushman, Darby & Cushman

[57] ABSTRACT

The invention relates to a connecting means for a lamp holder comprising a halogen lamp, provided with an elongated insert portion with a metal contact pin and a contact sleeve disposed co-axially with respect to said contact pin. The contact pin is fixedly mounted in and extends along part of its length into an insulation sleeve formed of an insulating material, which is surrounded along part of its length by the contact sleeve, in such a manner that the exposed part of the contact sleeve is confined between a part of the insulation sleeve surrounding the contact pin which projects from the contact sleeve, and a connecting means of an insulating material surrounding the contact sleeve. The connecting means is furthermore provided with a passage for lines attached to the contact pin and the contact sleeve, by means of which the contact pin and the contact sleeve can be connected to contact points located inside the lamp holder.

5 Claims, 2 Drawing Sheets

CONNECTING MEANS

The invention relates to a connecting means for a lamp holder comprising a halogen lamp, provided with an elongated insert portion with a contact pin and a contact sleeve disposed co-axially with respect to said contact pin, whereby insulating material is provided between the contact pin and the contact sleeve.

With conventional constructions of connecting means for lamp holders comprising a halogen lamp the contact sleeve is directly attached to or forms part of a support, usually made of a metal, which supports the lamp holder, said support e.g. being made in the shape of a tubular means. In principle such a construction can be used, since usually a low voltage of ±12 volts is used with halogen lamps. In practice it has become apparent, however, that in those cases in which the lamps are connected by laymen, there is a very real danger that a direct connection is made between the contact sleeve, and thus between the carrier supporting the lamp holder and the mains carrying a voltage of 120 or 220 volts, which involves enormous risks.

From U.S. Pat. No. 3,865,463 a connecting means is known which is suitable for being accommodated in a housing for a cigarette lighter provided in a car. Said connecting means comprises a contact pin, which is movable in the longitudinal direction of the housing of the connecting means, said contact pin being movable within the housing between a conductive leaf spring, which, with its end remote from the contact pin, is connected to the end of a conductor in a coupling sleeve. The contact pin is thereby accommodated in a shell-shaped part of the housing, which at one end connects with a further shell-shaped part co-axially surrounding the shell-shaped part accommodating the contact pin. The wall of said further shell-shaped part has an opening, through which a U-shaped end of a further leaf spring projects, said further leaf spring likewise being connected to the end of a conductor in a coupling sleeve. The two leaf springs are separated from each other by a sleeve accommodated withing the further shell, whereby the sleeve surrounding the leaf spring connects with the contact pin. The part of the housing consisting of the two shell-shaped parts is inserted into a cup-shaped means, in which the coupling sleeves are mounted. Said connecting means comprises a large number of parts and the assembly of such a connecting means will be a time consuming activity.

From U.S. Pat. No. 2,625,577 a plug for a switchboard is known, whereby the part of the plug to be inserted into the switchboard comprises four radially extending ribs turned through an angle of 90° with respect to each other, said ribs being placed in a body consisting of an insulating material, which extends in a tubular metal sleeve. Shanks connecting with the ribs and extending through the body consisting of an insulating material project from the insulating body at the end remote from the ribs, so as to be connected to further conductors. Said ends of the shanks projecting from the insulating body are located near a recess provided in a circumferential wall of the metal sleeve, so as to render the ends in question accessible for connecting purposes. Said end of the metal sleeve provided with an opening is in turn surrounded by an insulating covering.

The construction of this known structure with the four ribs and the conductive shanks connecting therewith is complicated and unsuitable for being used as a connecting means for a lamp holder comprising a halogen lamp.

From French Patent No. 601,195 a construction is known in which a contact pin to be connected to the mains is surrounded by a sleeve, which is separated from the contact pin by an insulating ring. A metal sleeve forming part of a lamp support and being surrounded by an insulating covering is to be inserted into said sleeve, whereby the metal sleeve is to make contact with the contact pin. When the support is detached from the lamp the contact pin supplying current is freely accessible from the outside, with all the consequent dangers.

From German Patent Application No. 3,111,832 a reading lamp is furthermore known, which has a connecting piece to be inserted into the housing of a cigarette lighter provided in a car or the like. Use is hereby made of an adaptor, which at its outer circumference is provided with four regularly spaced leaf springs and two locking fingers, which function to hook into a plug which is to be inserted into the housing of the cigarette lighter. Said publication does not give an exact construction of these means.

The object of the invention is to obtain a connecting means for a lamp holder comprising a halogen lamp wherein the dangers of the known construction, in particular of the lamp holder support or the lamp holder itself becoming alive, can be avoided, whist a simple, inexpensive construction is used.

According to the invention this can be achieved in that the contact pin is fixedly mounted in and extends along part of its length into an insulation sleeve formed of an insulating material, which is surrounded along part of its length by the contact sleeve, in such a manner that the exposed part of the contact sleeve is confined between a part of the insulation sleeve surrounding the contact pin which projects from the contact sleeve, and a connecting means of an insulating material surrounding the contact sleeve, said connecting means near its end directed towards the contact pin being provided with a circular groove in its outer circumference, so as to receive locking means, whilst the connecting means is furthermore provided with at least one passage for lines attached to the contact pin and the contact sleeve, by means of which the contact pin and the contact sleeve can be connected to contact points located inside the lamp holder, whilst the connecting means is suitable for being connected to a lamp holder support, in such a manner that the support is separated from the contact sleeve by the connecting means.

By using a connecting means according to the invention a simple, rugged construction of said connecting means assembled from parts occupying a fixed position with respect to each other can be obtained, whereby an electrically conducting connection between the contact sleeve and the lamp holder of the halogen lamp or conductive parts connected to said lamp holder is avoided.

The invention will be explained in more detail hereafter, with reference to a few possible embodiments of the construction according to the invention illustrated in the accompanying Figures.

Figure 1:
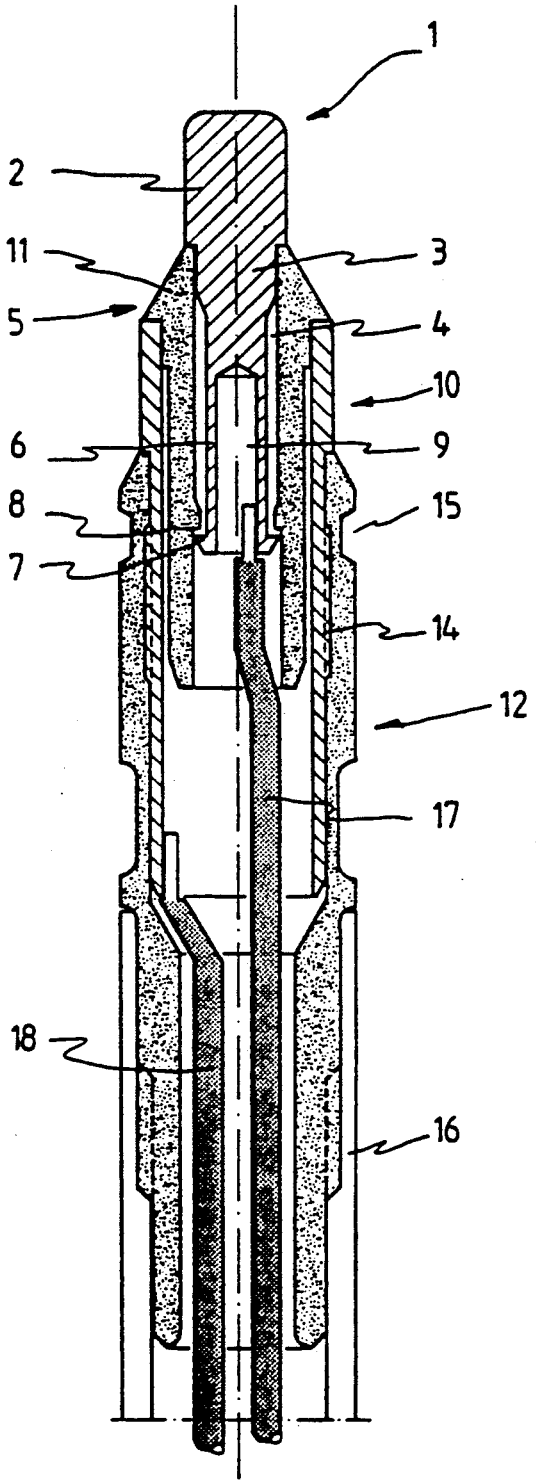
FIG. 1 is a longitudinal section of a first embodiment of a connecting means according to the invention.

The connecting means illustrated in FIG. 1 comprises a contact pin 1, which has a freely projecting head 2, which connects with a connecting part 3 having a smaller diameter, said connecting part being accommodated in a bore 4 with a driving fit, said bore being provided in a sleeve 5 consisting of an insulating material. A shank 6 positioned in the bore 4 of the sleeve 5 connects with the connecting part 3 of the contact pin 1, said shank at its lower end being provided with a projecting collar 7. As will be apparent from FIG. 1 said projecting collar 7 is snapped under a collar 8 forming part of the sleeve 5 when the contact pin 1 is pressed into the sleeve 5, said collar projecting into the interior of the bore 4. In the shank 6 there is furthermore provided a blind bore 9.

The sleeve 5 is inserted into a contact sleeve 10, which, like the contact pin 1, consists of a conductive material. A conical head part 11 thereby rests on one end of the contact sleeve 10, whilst a part of the sleeve 5 located under said head part 11 of the sleeve 5 is accommodated in the upper end of the contact sleeve 10 with a close fit.

As is furthermore apparent from FIG. 1 the outer circumference of the sleeve 10 is stepped, whilst the sleeve 10 extends along a large part of its length into a tubular connecting means 12 formed of an insulating material. The diameter of the end of the contact sleeve 10 projecting from the tubular connecting means 12 is slightly larger than the part of the contact sleeve 10 surrounded by the sleeve 12, as a result of which the contact sleeve 10 has a shoulder 13 at the location of the transition between these two parts having different external diameters, said shoulder-13 abutting against one end of the connecting means 12.

The part of the contact sleeve 10 located inside the connecting means has a slightly larger diameter along a part 14 of its length than the parts of the contact sleeve 10 positioned on both sides of said part 14, said part of the contact sleeve having a larger diameter being accommodated in a corresponding recess formed in the interior of the connecting means 12, so that the contact sleeve 10 is securely clamped down in the connecting means 12.

A circular groove 15 is provided in the outer circumference of the tubular connecting means 12, near the end where the contact sleeve 10 projects from the connecting means 12. Said groove functions to accommodate locking means which retain the connecting means when the end of said elongated connecting means having the contact pin 1 and the contact sleeve 10 is inserted into a junction box or the like, in which live contacts co-operating with the contact pin and the contact sleeve in the coupled position are disposed.

The end of the connecting means 12 remote from the contact pin 1 may e.g. be inserted or screwed into a tubular support 16, which may e.g. be connected to a lamp holder or the like with its end remote from the connecting means 12.

As is furthermore illustrated in FIG. 1 the ends of current supply wires 17 and 18 are soldered onto the contact pin 1 and the contact sleeve 10 respectively. Said current supply wires are furthermore passed through the inside of the various means, as is illustrated in FIG. 1, and may be connected with their other ends to contact points accommodated in the lamp holder, via which contact points current is supplied to the halogen lamp provided in the lamp holder.

When using the construction according to the invention the contact sleeve is surrounded, at least along that part which may be visible and within reach when the connecting means is used, by the connecting means 12 made of an insulating material, which at the same time insulates the contact sleeve from the support 16 for the lamp holder, which may be made of a metal.

It will be apparent, therefore, that by using the construction according to the invention it is prevented in a simple manner that possibly live parts are not sufficiently protected.

Figure 2:
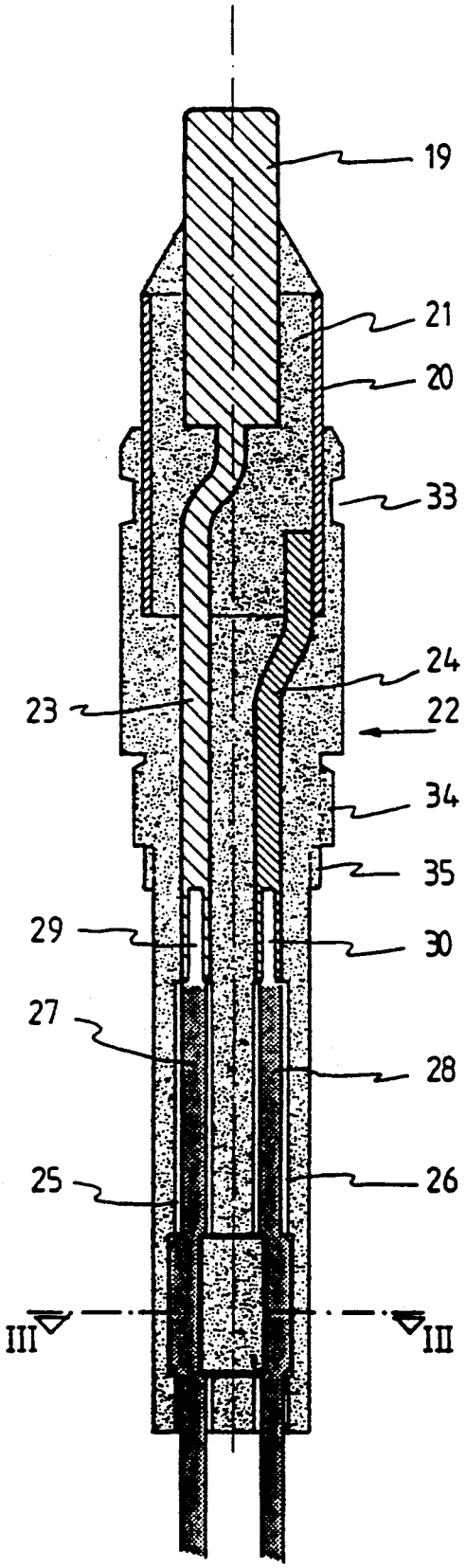
FIG. 2 is a longitudinal section of a second embodiment of a connecting means according to the invention.

Of course variations to the above-described embodiment are conceivable within the spirit and scope of the invention. Thus FIG. 2 shows an embodiment of a connecting means according to the invention, provided with a contact pin 19 and a contact sleeve 20. The contact pin 19 extends into the interior of the contact sleeve 20 along part of its length and is separated from said contact sleeve 20 by an insulating material 21 which is introduced, preferably by pouring, into the contact sleeve. The contact sleeve 20 is surrounded along part of its length by the upper end of a connecting means 22 formed of an insulating material.

A conductive line 23 embedded in the insulating material 21 and the insulating material 22 is connected to the end of the contact pin 19 surrounded by the contact sleeve 20, said line extending into said connecting means along part of the length of the connecting means 22. Said line 23 is thereby provided, at its end remote from the contact pin 19, with a blind bore extending in the longitudinal direction of the line 23.

In a similar manner a conductive line 24 extending substantially parallel to the line 23 is connected with one end to the contact sleeve 20. In the other end of the line 24 remote from the contact sleeve 20 another blind bore is provided, which extends in the longitudinal direction of said line. Said bores open into passages 25 and 26 respectively extending through the connecting means in line with and co-axially with respect to said blind bores, said passages terminating at the end of the connecting means 22 remote from the contact pin 19.

Figure 3:
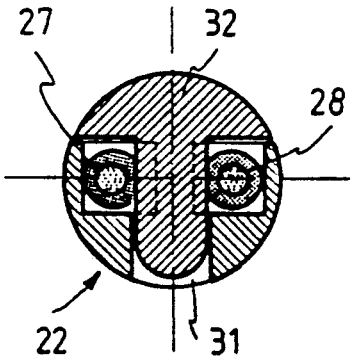
FIG. 3 is a sectional view of FIG. 2, along the line III—III in FIG. 2.

As is furthermore illustrated in FIGS. 2 and 3 lines 27 and 28 respectively may be inserted into said passages 25 and 26, the ends 29 and 30 respectively of said lines, stripped of the insulating material, being inserted into the blind bores of the lines 23 and 24. The lines 27 and 28 may be connected with their other ends to contacts accommodated in a lamp holder or the like.

In order to clamp down the lines 27 and 28 on the connecting means 22 a T-shaped recess 31 is provided in the connecting means, one leg of said T-shaped recess 31 extending between the passages 25 and 26 and being in open communication therewith. A T-shaped clamping piece 32, clamping itself down in the T-shaped recess, may be pressed into said T-shaped recess, said clamping piece being shaped such that it clamps down the wires 27 and 28 in the manner illustrated in FIG. 3.

A circular groove 33 corresponding with the groove 15 is provided in the end of the connecting piece 22 located near the contact sleeve. Spaced by some distance from said groove 33 the connecting means is provided with flat sides 34 extending parallel to each other, which sides may be used for sliding a spanner on the connecting means. Under the flat sides 34 the connecting means is provided with an externally threaded part 35. The lower part of the connecting means, when seen in FIG. 2, may be inserted into e.g. a tubular support connected to a lamp holder or the like, said support at its upper end being provided with internal screw thread corresponding with the screw thread 35, so that the connecting means can be screwed on the support in question.

The connecting means may e.g. be effectively formed by placing the contact pin 19 and the contact sleeve 20 with the lines 23 and 24 connected thereto in a suitably shaped mould, whose shape is adapted to the shape of the connecting means. By subsequently filling the mould with a suitable insulating plastic material the connecting piece aimed at is obtained, while simultaneously interconnecting the contact pin 19 and the contact sleeve.

I claim:

1. A connecting means for a lamp holder comprising a halogen lamp, provided with an elongated insert portion with a metal contact pin and a contact sleeve disposed co-axially with respect to said contact pin, whereby insulating material is provided between the contact pin and the contact sleeve, characterized in that the contact pin is fixedly mounted in and extends along part of its length into an insulation sleeve formed of an insulating material, which is surrounded along part of its length by the contact sleeve, in such a manner that the exposed part of the contact sleeve is confined between a part of the insulation sleeve surrounding the contact pin which projects from the contact sleeve, and a connecting means of an insulating material surrounding the contact sleeve, said connecting means near its end directed towards the contact pin being provided with a circular groove in its outer circumference, so as to receive locking means, whilst the connecting means is furthermore provided with at least one passage for lines attached to the contact pin and the contact sleeve, by means of which the contact pin and the contact sleeve can be connected to contact points located inside the lamp holder, whilst the connecting means is suitable for being connected to a lamp holder support, in such a manner that the support is separated from the contact sleeve by the connecting means.

2. A connecting means according to claim 1, characterized in that the end of the contact pin located inside the insulation sleeve is provided with a projecting collar, which co-operates with an inwardly projecting collar in the interior of the insulation sleeve, so as to prevent the contact pin from sliding out of the insulation sleeve.

3. A connecting means according to claim 1 or 2, characterized in that the part of the contact sleeve located inside the connecting means is provided with a projecting part, which is accommodated in a corresponding recess in the interior of the connecting means.

4. A connecting means according to claim 1 or 2 characterized in that lines connected to the contact pin and the contact sleeve, which are embedded in the material of the connecting means, are provided with blind bores at their ends remote from the contact sleeve and the contact pin respectively, said blind bores opening into passages extending in the longitudial direction of the connecting means, so as to accommodate the ends of further lines leading to the contact points in the lamp holder.

5. A connecting means according to claim 4, characterized in that a cross passage is provided in the connecting means, in which a clamping piece clamping down said further lines in the connecting means is to be introduced.

* * * * *